US009107523B1

(12) United States Patent
Goldsmith

(10) Patent No.: US 9,107,523 B1
(45) Date of Patent: Aug. 18, 2015

(54) REUSABLE STRAW GUIDE CONTAINER THAT HOLDS DRY ICE

(71) Applicant: Ira Goldsmith, Miami, FL (US)

(72) Inventor: Ira Goldsmith, Miami, FL (US)

( * ) Notice: Subject to any disclaimer, the term of this patent is extended or adjusted under 35 U.S.C. 154(b) by 0 days.

(21) Appl. No.: 14/666,794

(22) Filed: Mar. 24, 2015

(51) Int. Cl.
*A47G 19/22* (2006.01)
*F25D 3/14* (2006.01)
*F25D 31/00* (2006.01)

(52) U.S. Cl.
CPC ..... *A47G 19/2288* (2013.01); *A47G 19/2222* (2013.01); *F25D 3/14* (2013.01); *F25D 31/003* (2013.01); *F25D 2303/0821* (2013.01); *F25D 2303/08221* (2013.01); *F25D 2331/808* (2013.01)

(58) Field of Classification Search
CPC ..... A47G 19/22; A47G 19/2288; A47G 19/2222; F25D 31/003; F25D 3/14
USPC ..... 220/710
See application file for complete search history.

(56) References Cited

U.S. PATENT DOCUMENTS

| | | | | | |
|---|---|---|---|---|---|
| 4,234,080 | A * | 11/1980 | Gellert | 206/0.82 |
| 5,129,238 | A * | 7/1992 | Schwartz et al. | 62/457.3 |
| 7,552,674 | B1 * | 6/2009 | Cotter | 99/426 |
| 8,333,145 | B2 * | 12/2012 | Kowlessar | 99/426 |
| 8,833,597 | B1 * | 9/2014 | Goldsmith | 220/710 |
| 2004/0118769 | A1 * | 6/2004 | Merino | 210/459 |
| 2010/0170269 | A1 * | 7/2010 | Yeung et al. | 62/60 |
| 2012/0325835 | A1 * | 12/2012 | Merino | 220/705 |
| 2014/0166680 | A1 * | 6/2014 | St. Gelais | 220/710 |

* cited by examiner

*Primary Examiner* — Anthony Stashick
*Assistant Examiner* — Jennifer N Zettl
(74) *Attorney, Agent, or Firm* — Ruben Alcoba, Esq.

(57) ABSTRACT

A reusable straw guide container holds dry ice pellets, and is operable with a beverage container. The dry ice pellet is immersed in a beverage to keep it cool and create a mist. The dry ice pellet is loaded into a housing through an opening in a bottom region of the housing. A resilient gate covers the opening. The resilient gate is defined by a shape memory that biases the resilient gate to a closed position, which restricts access to and from the inside of the housing. A force applied on the dry ice pellet bends the resilient gate inwardly into the housing to enable entry of the pellet. After the pellet has passed through, the shape memory returns the resilient gate to the closed position. The housing has a top region having apertures and slits that enable the beverage to flow into contact with the pellet.

20 Claims, 7 Drawing Sheets

REUSABLE STRAW GUIDE CONTAINER THAT HOLDS DRY ICE

CROSS REFERENCE

The present invention is an improvement on U.S. application Ser. No. 14/332,383, which was a continuation in part of U.S. Pat. No. 8,833,597 that was filed on May 10, 2013 entitled a Straw Guide Container that Holds Dry Ice, the disclosure of which is incorporated herein by reference.

BACKGROUND

The present invention describes a reusable straw guide container that holds at least one dry ice pellet. The reusable straw guide container can be reused with multiple beverage containers and different types of beverages, chiefly due to a resilient gate loading mechanism that has a shape memory, and housing that remains fixedly closed, such the dry ice pellet remains trapped inside until consumed by the beverage. After the dry ice pellet is consumed in the beverage, a new dry ice pellet is loaded therein. The reusable straw guide container is also configured to clip onto a variety of beverage containers for further reusability.

It is known that the beverage industry is a multibillion dollar industry. There are myriad attempts to make beverages more interesting for consumption, and also to maintain the beverage at a cool temperature, which is often preferable to consumers. Ice cubes and colored glasses are known in the art to create this decorative and colorful effect. However, the inventor wondered if there was a more creative way to cool and present the beverage while also creating a reusable cooling mechanism therein.

The inventor knew that dry ice is the solid form of carbon dioxide. Dry ice is used as a cooling agent. Its advantages include lower temperature than that of water ice and not leaving any residue. Dry ice is useful for preserving frozen foods, ice cream, etc., where mechanical cooling is unavailable. Dry ice sublimes at about −78.5° Celsius at Earth atmospheric pressures. This extreme cold makes the solid dangerous to handle without protection due to burns caused by freezing. While generally not toxic, dry ice outgasses when put into contact with a warmer liquid.

The inventor realized that the longer cooling effects of dry ice in a beverage was more efficient than normal ice cubes. The inventor also recognized that the degassing of the dry ice created a mist affect that was unique and entertaining. The inventor decided to combine these two unique advantages into a reusable straw guide container that holds dry ice.

The inventor realized that his prior invention had to be modified to prevent inadvertent accidents that could happen due to improper use of his invention. So the inventor decided to create a loading mechanism that made it easy to load dry ice pellets into the housing.

The inventor realized that the most cost effective way to use his invention would be to create a reusable straw guide holder. The straw guide holder, once loaded with a dry ice pellet could not be reopened until the dry ice pellet was consumed by the beverage. Then a new dry ice pellet could be loaded through a resilient gate at the opening of the housing.

He researched a rubber gasket having shape memory. This loading mechanism had to enable easy passage of the dry ice pellet into the housing, but also restrict the pellet from leaving the cavity. He recognized that cutting weak points into the resilient gate would facilitate pushing the dry ice pellet into the cavity. He also realized that the shape memory could close the opening once the dry ice pellet was pushed into the cavity of the housing.

The present invention uses dry ice pellets to cool drinks in which the reusable straw guide container is immersed while simultaneously producing a mist from the drink.

The container of the present invention is a device that may eliminate the use of ice cubes in some beverages. It is known in the food industry that some ice cube holding devices are not hygienic and the ice can be contaminated when using them.

The reusable straw guide container of the present invention can be repetitively used on a variety of beverage containers and beverages.

The reusable straw guide container of the present invention can be used on hot or cold beverages. When used on hot beverages, the mist effect is maximized.

A benefit of the present invention is that beverages in which the container is immersed in become carbonated. The beverage flavors and aroma are enhanced when the beverages are carbonated.

Ice cube holders for beverages have been used for economically and efficiently cool beverages and create an entertaining effect on the beverage, yet none with the present characteristics of the present invention. See Patent numbers: U.S. Ser. No. 13/891,315; U.S. Ser. No. 14/332,383; and U.S. Pat. No. 2,016,514.

For the foregoing reasons, there is a need for a reusable straw guide container that holds at least one dry ice pellet for cooling a beverage while simultaneously creating a decorative effect on the beverage.

SUMMARY

The present invention describes a reusable straw guide container that holds at least one dry ice pellet, while simultaneously creating a decorative effect on the beverage. The reusable straw guide container also uses a loading mechanism having a shape memory for easy loading of the dry ice pellet. The straw guide container may be operable with a beverage container, whereby the dry ice pellet is immersed in a beverage to keep it cool and create a degassing, or misting effect on the dry ice pellet.

In operation, the dry ice pellet is inserted into a housing of the container through an opening in the housing. A resilient gate covers the opening. The resilient gate is defined by a shape memory that biases the resilient gate to a closed position, which restricts access to and from the inside of the housing. A force applied on the dry ice pellet bends the resilient gate inwardly into the housing to enable entry of the dry ice pellet. After the dry ice pellet has passed through the resilient gate, the shape memory returns the resilient gate to the closed position.

Once the dry ice pellet is inside the straw guide container, the shape memory returns the resilient gate to the closed position to restrict the dry ice pellet from exiting the container. Furthermore, the container is fixedly closed, and therefore cannot be opened to access the dry ice pellet once it is inserted into the container. Because of the shape memory of the resilient gate, and the fixedly closed configuration of the housing, the straw guide container can be used multiple times. This helps reduce costs and provides a responsible conservation of materials. Additional advantages offered by the straw guide container are that it is ergonomically designed, it is reusable, and it is lightweight.

The straw guide container of the present invention comprises of a housing. The housing has a top region, a bottom region, and a plurality of walls. The walls form an approximately hexagonal shape and a cavity. In some embodiments, the top region is generally sloped and has a plurality of apertures. The apertures enable passage of a liquid into the cavity. The bottom region of the housing has an opening. The opening is configured to allow the dry ice pellet to be inserted into the cavity of the housing.

A resilient gate covers the opening in the bottom region of the housing. The resilient gate is defined by a shape memory. The shape memory biases the resilient gate to substantially restrict passage through the opening and remain in a closed position.

A force applied by the dry ice pellet on the resilient gate pushes the resilient gate inwardly, towards the cavity. The resilient gate, thus expands at a central hole and a plurality of outer slots to an open position. The central hole and outer slots create weak points that enable the resilient gate to bend inwardly into the cavity, which consequently allows the dry ice pellet to be inserted therein. A plurality of lifts form around the central hole to restrict the dry ice pellet from clogging the outer slots and the central hole.

In some embodiment, a straw guide serves to enable a straw to pass through a channel and into a beverage. The straw guide fixedly attaches to at least one of the walls of the housing. The straw guide extends along the length of the walls. The container further includes a stem for handling and controlling the straw guide container. The stem has a first end and a second end. The first end of the stem defined by a substantially circular handle. The second end of the stem attaches to the top region of the housing.

One objective of the present invention is to provide a straw guide container that cools a beverage in which it is immersed after the straw guide container is loaded with at least one dry ice pellet.

Another objective is to provide a reusable straw guide container that can repetitively clip on to multiple beverage containers for immersion into different types of beverages.

Another objective is to provide a reusable straw guide container for cooling and creating a degassing effect on the dry ice pellet.

Another objective is to provide a housing that can safely house carbon dioxide pellets in a cavity of the housing, since the housing is fixedly closed and cannot be opened.

Yet another objective is to provide a straw guide container that enhances the flavor and aroma of a beverage when it is loaded with the dry ice pellet.

Yet another objective is to provide an ergonomically designed straw guide container that can be loaded with the dry ice pellet in a safe manner.

Yet another objective is to provide a straw guide container that eliminates the need to use ice cubes to cool a beverage.

Yet another objective is to provide a straw guide container that can help carbonate a beverage in which it is immersed in when it is loaded with the dry ice pellet.

DRAWINGS

These and other features, aspects, and advantages of the present invention will become better understood with regard to the following description, appended claims, and drawings where:

FIG. 5A is a top perspective view, and FIG. 5B is an elevated side view;

DESCRIPTION

Figure 1:
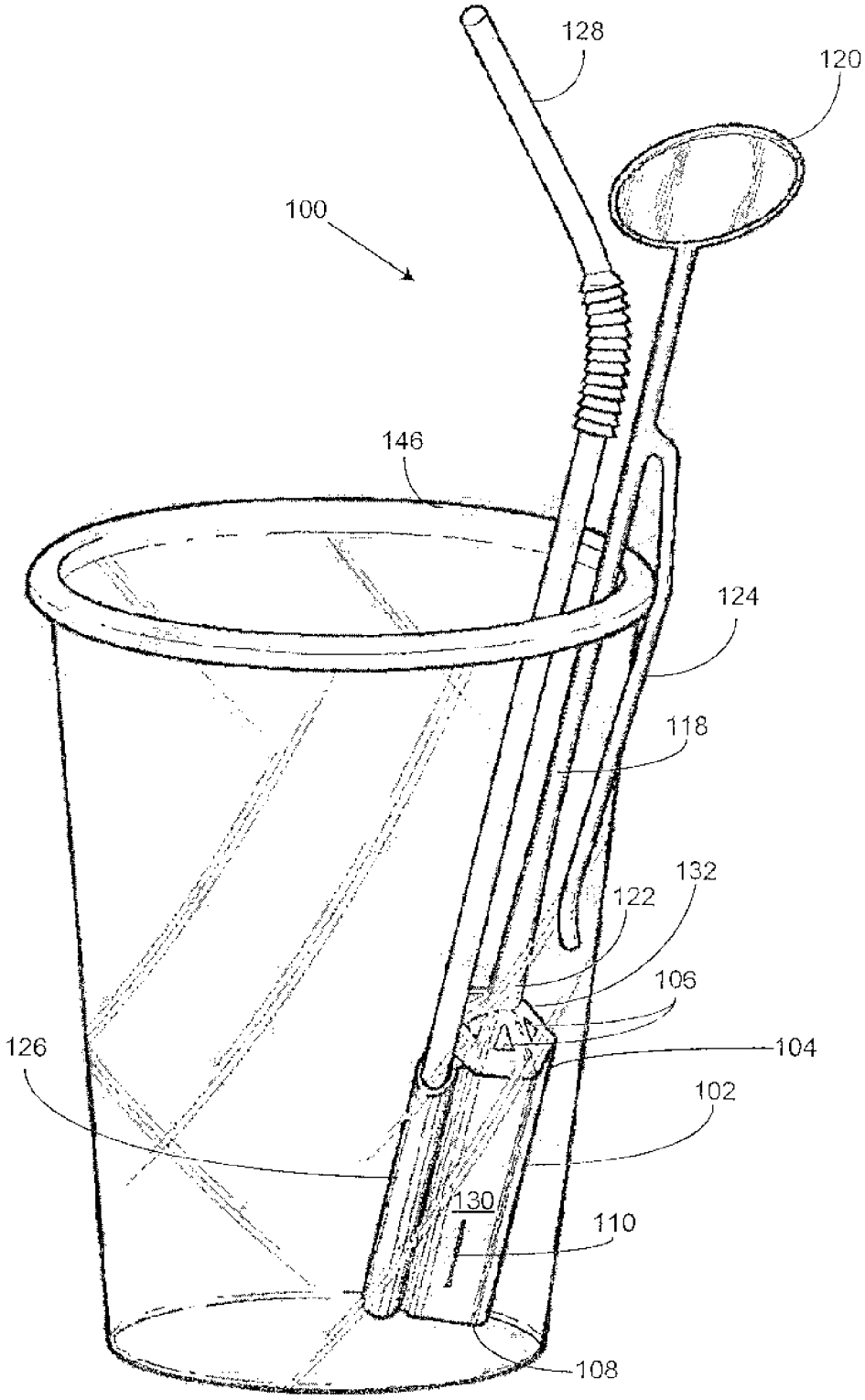
FIG. 1 is a perspective view of an exemplary reusable straw guide container clipped onto an edge of an exemplary beverage container.

One embodiment, referenced in FIGS. 1-7, illustrates a reusable straw guide container 100 that holds at least one dry ice pellet 138 for cooling a beverage and creating a decorative effect on the beverage. As shown in FIG. 1, the reusable straw guide container 100 also uses a unique loading mechanism that has a shape memory for easy loading of the dry ice pellet 138. The reusable straw guide container 100 clips onto the edge of a beverage container 146 to immerse at least one dry ice pellet 138 into the beverage. The reusable straw guide container 100 is configured to fasten to a variety of beverage containers 146 and beverages, which further increases the reusability of the reusable straw guide container 100.

Figure 2:
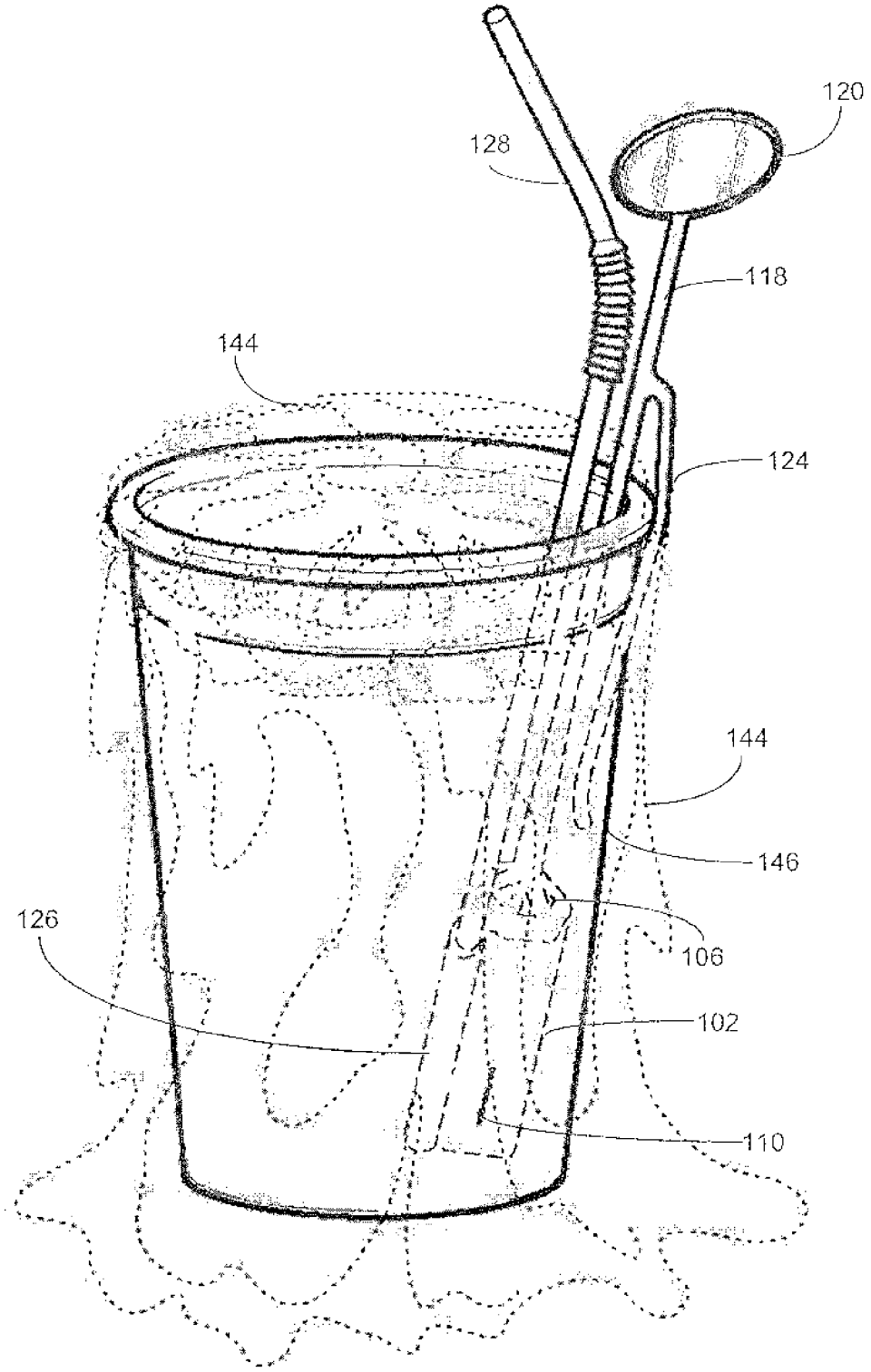
FIG. 2 is a perspective view of the reusable straw guide container clipped onto an edge of the beverage container, and an exemplary degassing zone forming around the beverage container.

As illustrated in FIG. 2, from within the reusable straw guide container 100, the dry ice pellet 138 immerses into the beverage, cooling the beverage, degassing, and consequently creating a misting visual effect around the beverage. The misting created by a degassing zone 144 is a desired consequence of the chemical properties of carbon dioxide, from which dry ice is composed. The reusable straw guide container 100 can be used on hot or cold beverages. When used on hot beverages, the mist from the degassing zone 144 effect is maximized.

Furthermore, the reusable straw guide container 100 can be reused on multiple beverage containers 146 and different types of beverages, chiefly due to its resilient gate 112 that has a shape memory, and a clip 124 that attaches the reusable straw guide container 100 to a variety of beverage container edges. The resilient gate 112 is configured to trap the dry ice pellet 138 in a cavity 140 inside the housing 102 until the dry ice pellet 138 is fully consumed by the beverage. A straw guide 126 provides a channel for inserting a straw 128 into the beverage container 146, such that the beverage can be sucked out of the beverage container 146. An elongated stem 118 provides a handling means to carry and manipulate the reusable straw guide container 100 and the attached beverage container.

Figure 3:
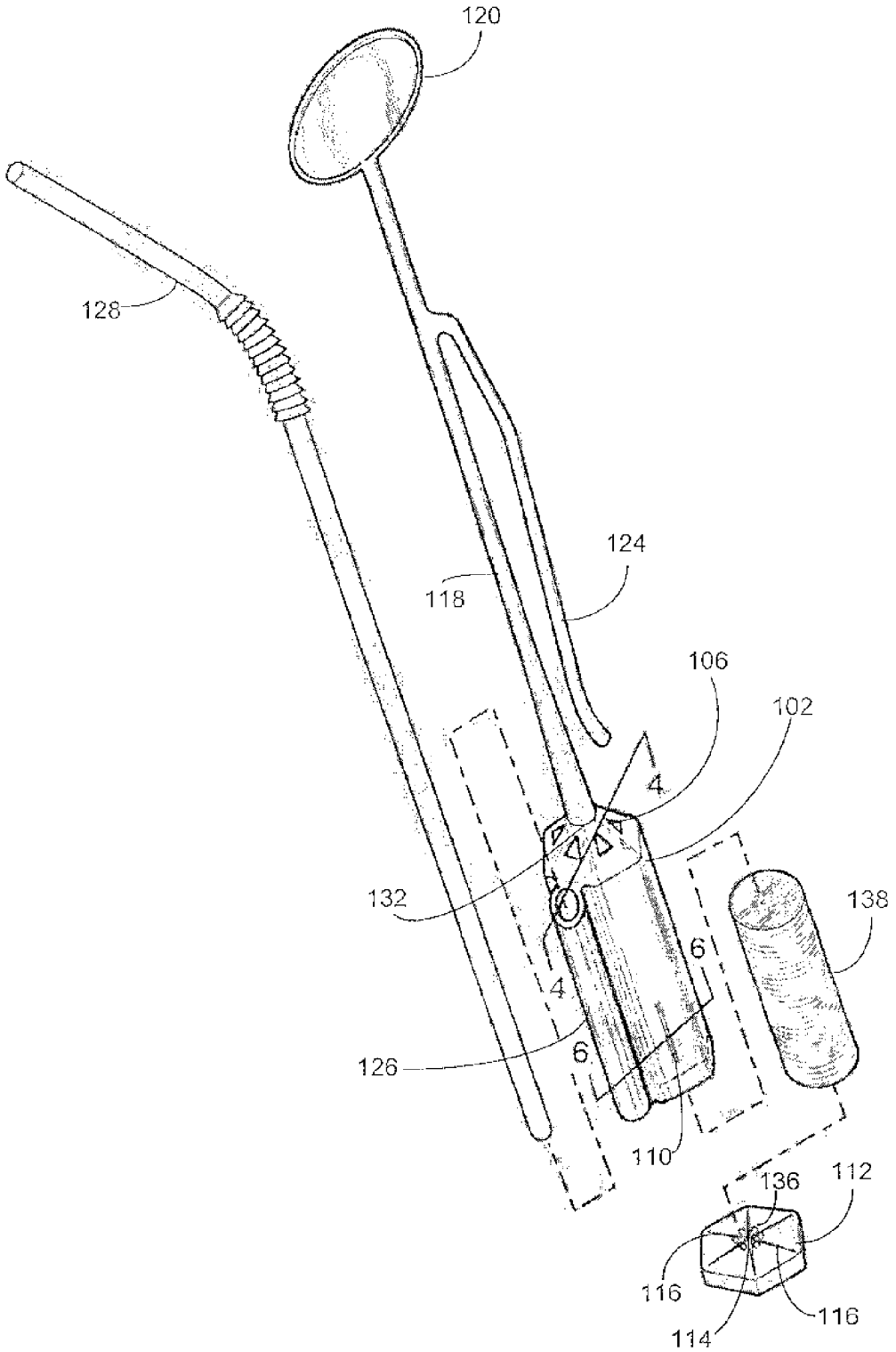
FIG. 3 is a perspective view of the reusable straw guide container with a resilient gate detached and at least one dry ice pellet disposed for entry through the opening in the resilient gate.

Turning now to FIG. 3, the reusable straw guide container 100 holds at least one dry ice pellet 138. The dry ice pellet 138 may be shaped and sized into a variety of dimensions effective for loading into the housing 102. The straw guide container 100 fastens onto a beverage container, whereby the dry ice pellet 138 is immersed in contact with the beverage to keep it cool and create a degassing zone 144 around the beverage container 146 from the dry ice pellet 138 immersing in the liquid beverage. The beverage container 146 may include, without limitation, a glass, a cup, a champagne glass, a beer mug, a jar, a carton, and a bowl. In any case, the reusable straw guide container 100 is operable with any beverage container 146 and can be used therein multiple times.

In operation, the dry ice pellet 138 is inserted into a housing 102 of the container 100 through an opening 142 that forms at a bottom region 108 of the housing 102. A resilient gate 112 covers the opening 142. The resilient gate 112 is defined by a shape memory that biases the resilient gate 112 to a closed position 136. The closed position 136 restricts access to and from the cavity 140 inside the housing 102. A force applied on the dry ice pellet 138 moves the resilient gate 112 to an open position 134 by bending the resilient gate 112 inwardly into the cavity 140 to enable entry of the dry ice pellet 138.

After the dry ice pellet 138 has passed through the resilient gate 112, the shape memory returns the resilient gate 112 to the closed position 136. The resilient gate 112 may have a central hole 114 and a plurality of outer slots 116 that create weak points along the surface of the resilient gate 112 to facilitate bending the resilient gate 112 inwardly, as such.

Once the dry ice pellet 138 is inside the housing 102, the shape memory returns the resilient gate 112 to the closed position 136 to restrict the dry ice pellet 138 from exiting the housing 102. Furthermore, the housing 102 cannot be opened to access the dry ice pellet 138 once it is inserted into the housing 102. Because of the shape memory of the resilient gate 112, and the clip 124 that attaches the reusable straw guide container 100 to a variety of beverage container edges, the straw guide container 100 can be used multiple times. This helps reduce costs and provides a responsible conservation of materials. Additional advantages offered by the straw guide container 100 are that it is ergonomically designed, it is reusable, and it is lightweight.

As referenced in FIG. 1, the straw guide container 100 of the present invention comprises a housing 102. The housing 102 has a top region 104, a bottom region 108, and a plurality of walls 130. The walls 130 may form an approximately hexagonal shape. However, in other embodiments, the walls 130 may form the housing 102 into other shapes. In one embodiment, four walls 130 are used. However in other embodiments, any number of walls 130 may be used. The walls 130, the top region 104, and the bottom region 108 are enclosed to form a cavity 140.

In some embodiments, the top region 104 of the housing 102 is generally sloped and has a plurality of apertures 106. The apertures 106 enable the beverage to flow into the cavity 140 of the housing 102 to engage the dry ice pellet 138. The walls 130 of the housing 102 may also have a plurality of slits 110 that run along the length of the housing 102. The slits 110, similarly to the apertures 106 in the top region 104, allow the beverage to flow into the cavity 140 and contact the dry ice pellet 138.

Figure 4:
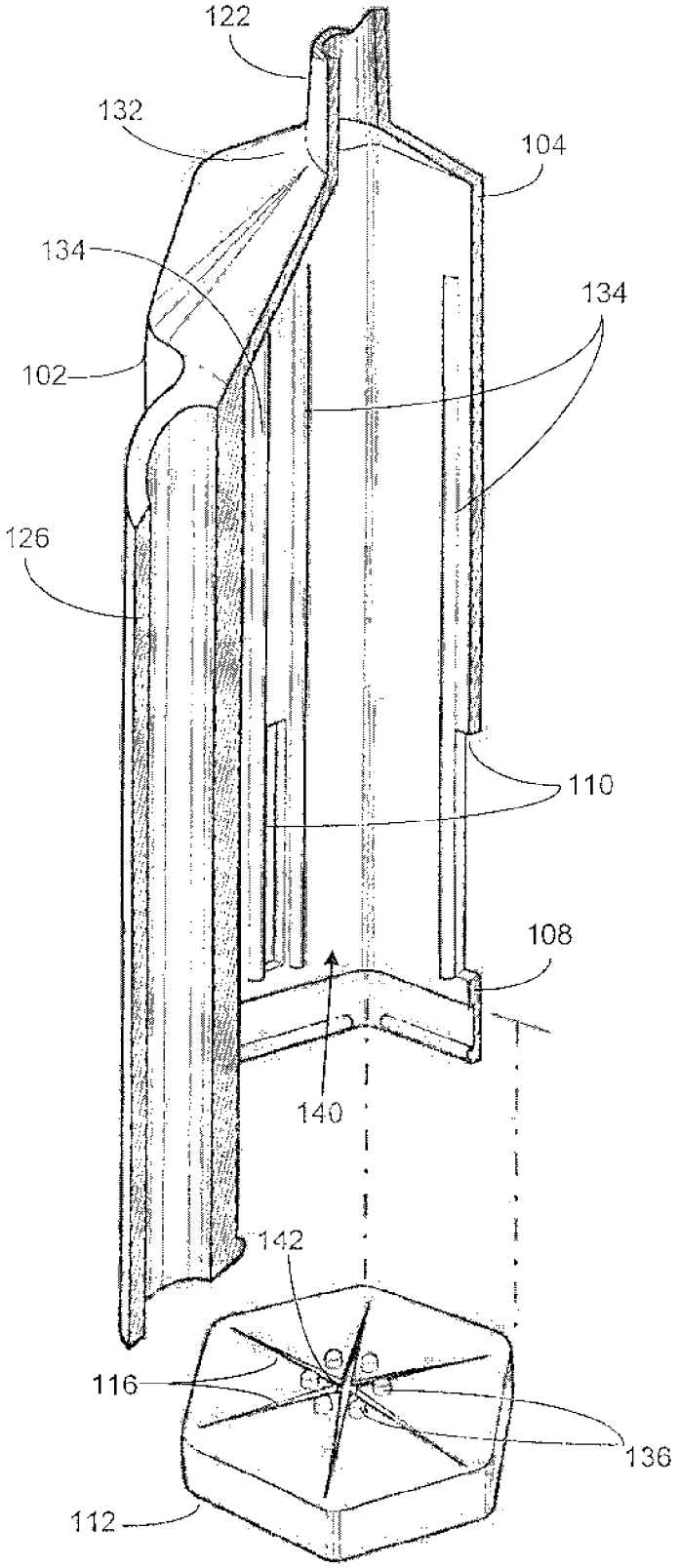
FIG. 4 is a sectioned side view of the reusable straw guide container, the section taken along section 4-4 of FIG. 3, detailing a cavity in the housing.

As referenced in FIG. 4, at least one ridge 134 aligns along the length of the slits 110. The ridge 134 restricts the dry ice pellet 138 from blocking free flow of the beverage in and out of the housing 102. The ridge 134 may include a slight protrusion that positions adjacent to the slit 110. In one embodiment, the top region 104 forms a generally pyramid shape, terminating at an apex 132. The top region 104 extends from one end of the walls 130 to the apex 132. Suitable materials for the housing 102 may include, without limitation, plastic, stainless steel, fiberglass, and glass. The materials are effective for allowing the straw guide container 100 to be reused.

Figure 5A:
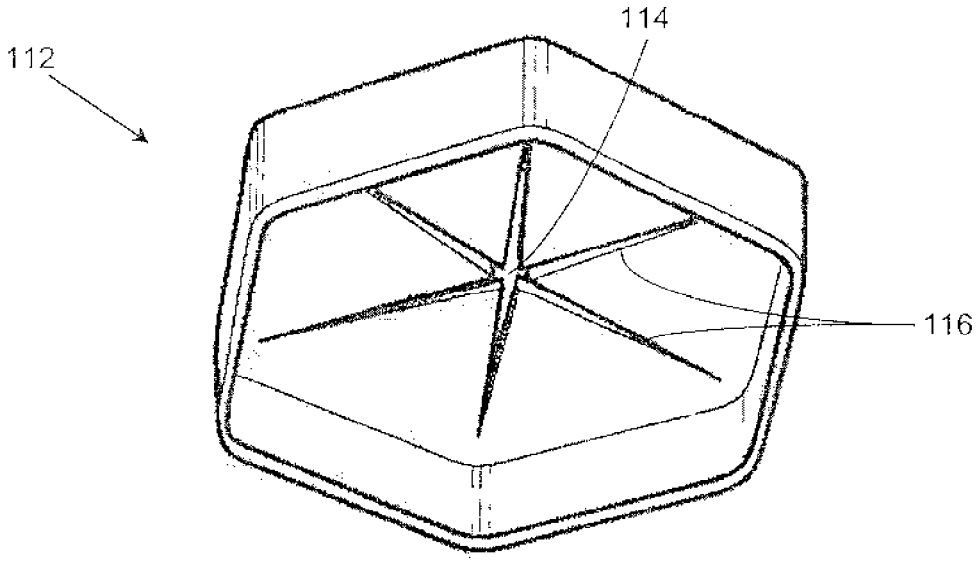
FIGS. 5A and 5B are views of a resilient gate, where

Turning now to FIG. 5A, the bottom region 108 of the housing 102 has an opening 142. The opening 142 may be circular. The opening 142 is configured to allow the dry ice pellet 138 to be inserted into the cavity 140 of the housing 102. A resilient gate 112 covers the opening 142 in the bottom region 108 of the housing 102. The resilient gate 112 may include a rubber gasket that fits over the circular opening 142 in the bottom region 108 of the housing 102.

Figure 5B:
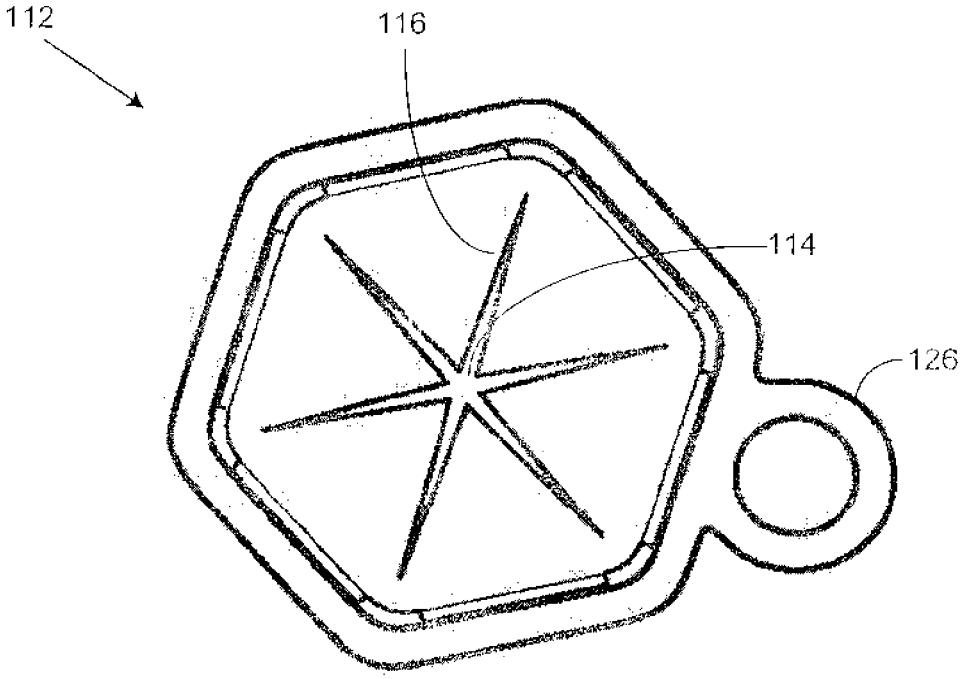

Looking at FIG. 5B, the resilient gate 112 has a central hole 114 and a plurality of outer slots 116 that allow the beverage to flow into contact with the dry ice pellet 138 in the cavity 140. In one possible embodiment, a plurality of lifts 136 form around the central hole 114 to restrict the dry ice pellet from clogging the outer slots 116 and the central hole 114. In some embodiments, the lifts 136 may include small protrusions that position adjacently to, and encircle the central hole 114. The central hole 114 and outer slots 116 are also useful for creating weak points along the surface of the resilient gate 112. These weak points enable the resilient gate 112 to bend inwardly into the cavity 140, which consequently allows the dry ice pellet 138 to be inserted therein.

Figure 6:
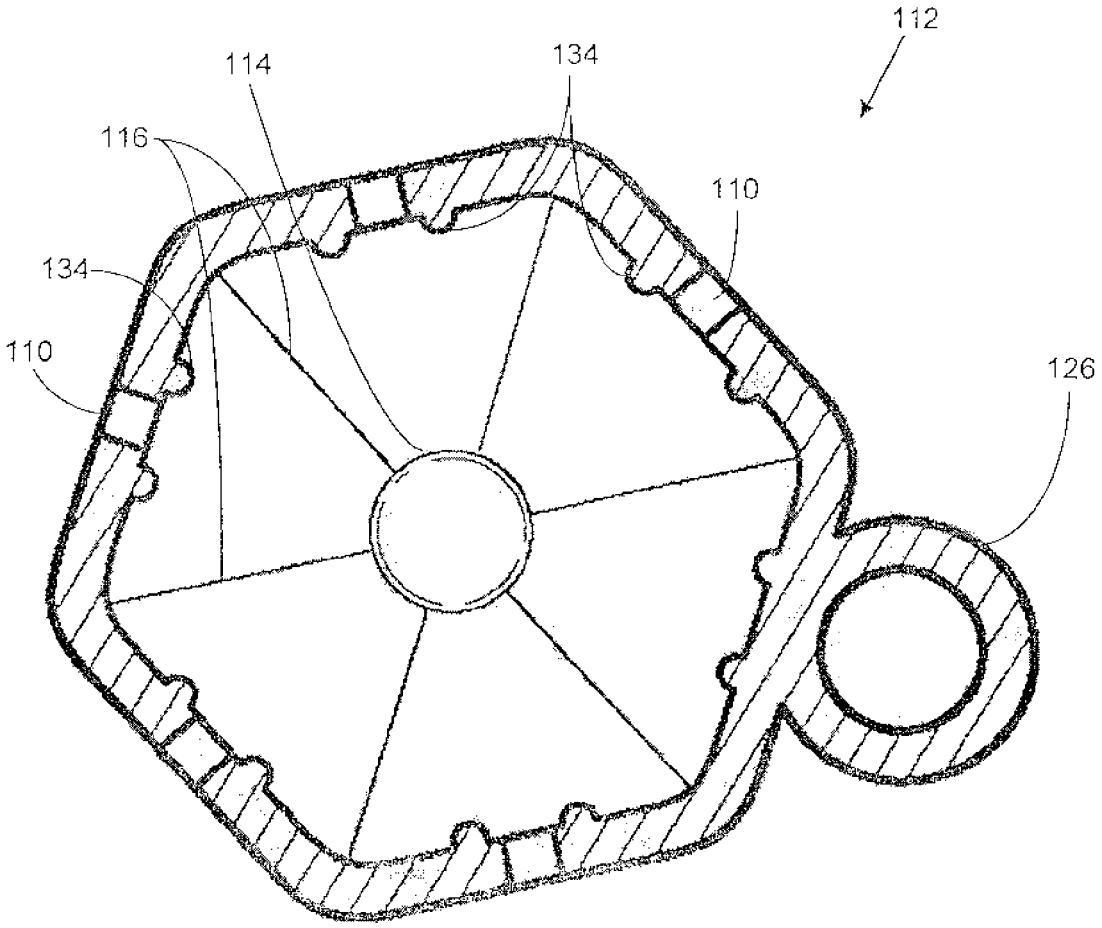
FIG. 6 is a sectioned side view of the resilient gate, the section taken along section 6-6 of FIG. 3, detailing ridges and slits from the walls, and an opening in the resilient gate.

Looking at FIG. 6, the resilient gate 112 has a shape memory. The shape memory biases the resilient gate 112 to a closed position 136 over the opening 142, which substantially restricts passage of the dry ice pellet 138 outside the housing 102.

A force applied by the dry ice pellet 138 on the resilient gate 112 causes the resilient gate 112 to bend into the cavity 140 to form the open position 134. In the open position 134, the central hole 114 in the resilient gate 112 is expanded and bent into the cavity 140. This flexible capacity of the resilient gate 112 enables the dry ice pellet 138 to be easily pushed into the cavity 140.

Figure 7:
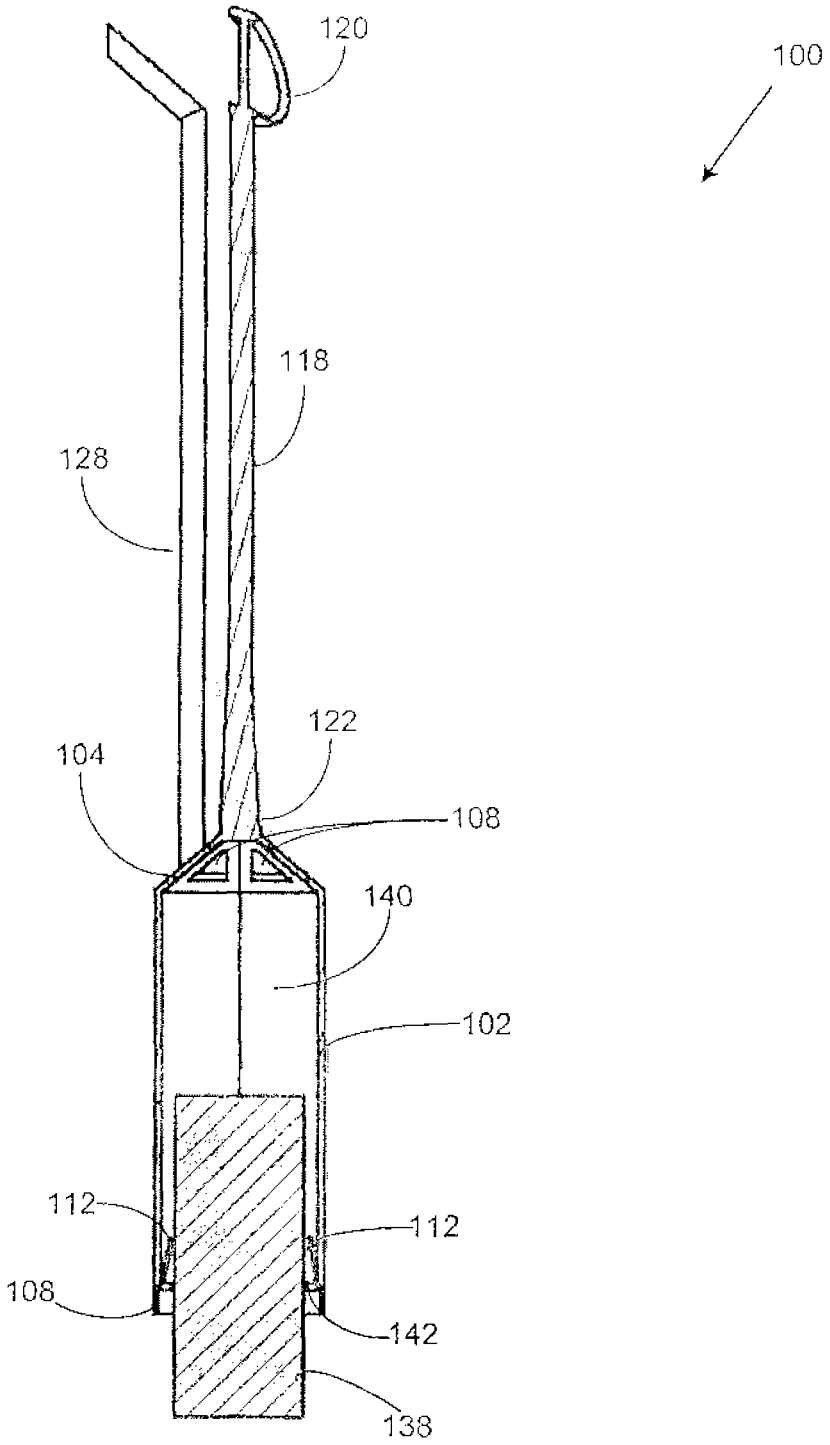
FIG. 7 is a sectioned side view of the reusable straw guide container that holds dry ice receiving an exemplary dry ice pellet through the opening.

In one example highlighted in FIG. 7, the dry ice pellet 138 is pushed through the resilient gate 112, concentric to the central hole 114. The force applied by the dry ice pellet 138 increases the size of the central hole 114 and pushes the resilient gate 112 inward, towards the cavity 140. This creates a passage through the opening 142 of the housing 102 that enables passage of the dry ice pellet 138 into the cavity 140 of the housing 102. After the dry ice pellet 138 has passed through the resilient gate 112, the shape memory biases the resilient gate 112 back to the closed position 136, whereby the opening 142 is substantially closed and the dry ice pellet 138 cannot disengage from within the housing 102.

In some embodiment, a straw guide 126 serves to enable a straw 126 to pass through a channel and into a beverage. The straw guide 126 fixedly attaches to at least one of the walls 130 of the housing 102. The straw guide 126 extends along the length of the walls 130 into the bottom region 108 of the housing 102. In this manner, a straw 126 can be inserted for sucking the beverage from the beverage container.

As shown in FIGS. 1 and 2, the container 100 further includes a stem 118 for handling and controlling the straw guide container 100. In one embodiment, the stem 118 is generally elongated and rigid. The stem 118 extends from the top region 104 of the housing 102 to provide a stable handle for manipulating the housing 102 in relation to the beverage container. The stem 118 has a first end 120 and a second end 122. The first end 120 of the stem 118 may include a substantially circular handle. However, in other embodiments, the handle may have other shapes, including, without limitation, a rectangular shape, a square shape, a triangular shape, and an oval shape. The second end 122 of the stem 118 attaches to the top region 104 of the housing 102.

In some embodiments, a clip 124 may attach along a longitudinal axis of the stem 118. The clip 124 fastens the straw guide container 100 to the edge of the beverage container 100 by creating an inward tension. In one embodiment, the clip 124 is detachable from the stem 118. In another embodiment, other types of fasteners may be used to secure the straw guide container 100 to the edge of the beverage container. Suitable materials for the clip 124 may include, without limitation, plastic, stainless steel, and metal alloys.

In a further embodiment of the present invention, the straw guide container 100 has dimensions as follows: the length of the walls 130 are approximately 2.625 inches from the apex 132 at the top region 104 to the bottom region 108 of the housing 102; the diameter between the opposing walls 130 of the housing 102 are approximately 0.850 inches; and the length of the straw guide 126 is approximately 2.625 inches.

In a further embodiment of the present invention, the straw guide container 100 further comprises of a straw 126 that is disposed to enter a channel in the straw guide 126.

In a further embodiment of the present invention, the straw guide container 100 may be made of plastic, polymers, or stainless steel.

In one advantage of the present invention, the straw guide container 100 cools a beverage in which it is immersed when it is loaded with at least one dry ice pellet 138.

In another advantage of the present invention, is that it provides a one-time use straw guide container 100 that safely houses at least one dry ice pellet 138 within it, for the housing 102 cannot be reopened and is fixedly closed.

In another advantage of the present invention, the resilient gate 112 restricts the dry ice pellet 138 from leaving the cavity 140 in the housing 102, but is still sufficiently pliable to enable the dry ice pellet 138 to be inserted into the cavity 140.

Yet another advantage is to restrict dry ice pellets 138 from blocking the free flow of the beverage through the slits 110 on the walls 130 of the housing 102 with at least one ridge 134.

Yet another advantage is to restrict dry ice pellets 138 from blocking the free flow of the beverage through the central opening 114 of the resilient gate 112 with a plurality of lifts 136.

Yet another advantage is to provide a straw guide container 100 that enhances the flavor and aroma of a beverage when it is loaded with the dry ice pellet 138.

Yet another advantage is to provide an ergonomically designed straw guide container 100 that can be loaded with the dry ice pellet 138 in a safe manner.

Yet another advantage is to provide a straw guide container 100 that eliminates the need to use ice cubes to cool a beverage.

Yet another advantage is to provide a straw guide container 100 that can help carbonate a beverage in which it is immersed in when it is loaded with the dry ice pellet 138.

While the inventor's above description contains many specificities, these should not be construed as limitations on the scope, but rather as an exemplification of several preferred embodiments thereof. Many other variations are possible. For example, the resilient gate 112 may pivot off the opening 142 of the housing 102 from a spring loaded hinge. Accordingly, the scope should be determined not by the embodiments illustrated, but by the appended claims and their legal equivalents.

What is claimed is:

1. A reusable straw guide container that holds dry ice, the container comprises:

a housing, the housing defined by a top region, a bottom region, and a plurality of walls that form a cavity within the housing, the top region of the housing having a plurality of apertures, the bottom region of the housing having an opening, the plurality of walls having a plurality of slits;

at least one ridge, the at least one ridge disposed to align along the length of the plurality of slits;

a resilient gate, the resilient gate defined by a central opening, a plurality of outer slots, and a shape memory, the resilient gate arranged to cover the opening in the bottom region of the housing, wherein the shape memory biases the resilient gate to substantially restrict passage through the opening;

a plurality of lifts, the plurality of lifts disposed to extend from the resilient gate towards the top region of the housing; and a straw guide, the straw guide fixedly attached to the plurality of walls of the housing, the straw guide arranged to extend along the length of the plurality of walls.

2. The reusable straw guide container of claim 1, wherein the container clips onto a beverage container containing a beverage.

3. The reusable straw guide container of claim 2, wherein the cavity in the housing holds at least one dry ice pellet.

4. The reusable straw guide container of claim 3, wherein the top region, the plurality of walls, and the bottom region form a housing having a generally hexagonal shape.

5. The reusable straw guide container of claim 4, wherein the plurality of apertures in the top region have generally triangular shapes.

6. The reusable straw guide container of claim 5, wherein the top region forms an apex.

7. The reusable straw guide container of claim 6, wherein the plurality of slits are disposed to extend vertically along the plurality of walls.

8. The reusable straw guide container of claim 7, wherein the plurality of apertures and the plurality of slits enable the beverage to flow into contact with the at least one dry ice pellet in the cavity of the housing.

9. The reusable straw guide container of claim 8, wherein the resilient gate is a rubber material.

10. The reusable straw guide container of claim 9, wherein the plurality of outer slots are sufficiently resilient so as to allow the central hole to expand for enabling passage of the at least one dry ice pellet.

11. The reusable straw guide container of claim 10, wherein the resilient gate moves between an open position and a closed position.

12. The reusable straw guide container of claim 11, wherein the shape memory biases the resilient gate to the closed position.

13. The reusable straw guide container of claim 12, wherein a force applied on the resilient gate by the at least one dry ice pellet bends the resilient gate to the open position to enable passage of the at least one dry ice pellet into the cavity of the housing.

14. The reusable straw guide container of claim 13, wherein the plurality of lifts are configured to restrict the at least one dry ice pellet from blocking the central opening of the resilient gate.

15. The reusable straw guide container of claim 14, further comprising a stem, the stem defined by a first end and a second end, the first end of the stem defined by a substantially circular handle, the second end of the stem configured to fixedly attach to the top region of the housing.

16. The reusable straw guide container of claim 15, wherein the stem has a clip.

17. The reusable straw guide container of claim 16, wherein the length of the stem is approximately 3.625 inches.

18. The reusable straw guide container of claim 17, wherein the container is made of stainless steel, the stainless steel configured to enable multiple uses.

19. The reusable straw guide container of claim 18, wherein the straw guide is configured to enable passage of a straw.

20. A reusable straw guide container that holds dry ice, the container comprises:

a housing, the housing defined by a top region, a bottom region, and a plurality of walls that form a cavity within the housing, the top region of the housing having a plurality of apertures, the bottom region of the housing having an opening, the plurality of walls having a plurality of slits;

at least one ridge, the at least one ridge disposed to align along the length of the plurality of slits;

a resilient gate, the resilient gate defined by a central opening, a plurality of outer slots, and a shape memory, the resilient gate arranged to cover the opening in the bottom region of the housing, wherein the shape memory biases the resilient gate to substantially restrict passage through the opening;

a plurality of lifts, the plurality of lifts disposed to extend from the resilient gate towards the top region of the housing;

a straw guide, the straw guide fixedly attached to the plurality of walls of the housing, the straw guide arranged to extend along the length of the plurality of walls; and a stem, the stem defined by a first end and a second end, the first end of the stem defined by a substantially circular handle, the second end of the stem configured to fixedly attach to the top region of the housing.

* * * * *